US010109392B2

(12) United States Patent
Maunder et al.

(10) Patent No.: US 10,109,392 B2
(45) Date of Patent: Oct. 23, 2018

(54) ELECTRICAL CABLES WITH STRENGTH ELEMENTS

(71) Applicants: PRYSMIAN S.P.A., Milan (IT); Andrew Maunder, Lexington, SC (US); Gonzalo Chavarria, Lexington, SC (US)

(72) Inventors: Andrew Maunder, Lexington, SC (US); Gonzalo Chavarria, Lexington, SC (US)

(73) Assignee: PRYSMIAN S.p.A., Milan (IT)

( * ) Notice: Subject to any disclaimer, the term of this patent is extended or adjusted under 35 U.S.C. 154(b) by 0 days.

(21) Appl. No.: 15/121,922

(22) PCT Filed: Feb. 28, 2014

(86) PCT No.: PCT/US2014/019500
§ 371 (c)(1),
(2) Date: Aug. 26, 2016

(87) PCT Pub. No.: WO2015/130308
PCT Pub. Date: Sep. 3, 2015

(65) Prior Publication Data

US 2017/0076838 A1 Mar. 16, 2017

(51) Int. Cl.
*H01B 11/04* (2006.01)
*H01B 7/04* (2006.01)
(Continued)

(52) U.S. Cl.
CPC ..... *H01B 7/041* (2013.01); *H01B 3/30* (2013.01); *H01B 7/1895* (2013.01)

(58) Field of Classification Search
CPC ..... H01B 11/04; H01B 9/027
(Continued)

(56) References Cited

U.S. PATENT DOCUMENTS 4,002,820 A 1/1977 Paniri et al.
4,467,138 A 8/1984 Brorein
(Continued)

FOREIGN PATENT DOCUMENTS

CH 537080 A 5/1973
CN 1462040 A 12/2003
(Continued)

OTHER PUBLICATIONS

International Search Report dated Dec. 5, 2014 from International Application No. PCT/US2014/019500, 5 pages.
(Continued)

*Primary Examiner* — Chau N Nguyen
(74) *Attorney, Agent, or Firm* — MH2 Technology Law Group, LLP

(57) ABSTRACT

An electrical cable may include: at least two first members extending along a length of the electrical cable, each of the first members including a conducting element and an insulating layer radially external to the conducting element; at least two second members extending along the length of the electrical cable, each of the second members including a strength element and a conductive layer radially external to the strength element; and/or the first and second members being stranded around and in contact with a cradle extending along the length of the electrical cable. The cradle may be made of polymeric material having a tensile modulus greater than or equal to 1 GPa and a Vicat softening temperature greater than or equal to 125° C.

20 Claims, 6 Drawing Sheets

(51) Int. Cl.
*H01B 7/18* (2006.01)
*H01B 3/30* (2006.01)

(58) Field of Classification Search
USPC ..... 174/113 R, 113 C, 113 AS, 115, 116, 174/126.4
See application file for complete search history.

(56) References Cited

U.S. PATENT DOCUMENTS

| | | | | |
|---|---|---|---|---|
| 4,956,523 | A | 9/1990 | Pawluk | |
| 2002/0010241 | A1* | 1/2002 | Pitteri | C08L 23/06 524/240 |
| 2003/0225198 | A1 | 12/2003 | Arbues | |
| 2008/0132627 | A1 | 6/2008 | Schultes et al. | |
| 2011/0272641 | A1* | 11/2011 | Bastiaens | B82Y 30/00 252/511 |
| 2012/0082422 | A1 | 4/2012 | Sarchi et al. | |
| 2012/0111603 | A1 | 5/2012 | Cofre et al. | |
| 2013/0269966 | A1* | 10/2013 | Emme | H01B 7/423 174/15.6 |

FOREIGN PATENT DOCUMENTS

| | | | |
|---|---|---|---|
| CN | 101107311 | A | 1/2008 |
| CN | 102460606 | A | 5/2012 |
| CN | 102543288 | A | 7/2012 |
| DE | 7613743 | U | 1/1978 |
| DE | 3224597 | A1 | 12/1983 |
| EP | 1507269 | A2 | 2/2005 |
| WO | 2010/136062 | A1 | 12/2012 |

OTHER PUBLICATIONS

Pirelli, "Flexible Electric Cables for Mining Applications". Flexible Electric Cables Catalog BU IS 2.3, 2000, 147 pages.
Chinese Office Action dated May 5, 2017, in CN Application No. 201480076398.5, 14 pages.

* cited by examiner

ELECTRICAL CABLES WITH STRENGTH ELEMENTS

CROSS-REFERENCE TO RELATED APPLICATION(S)

This application is a national stage entry from International Application No. PCT/US2014/019500, filed on Feb. 28, 2014, in the Receiving Office ("RO/US") of the U.S. Patent and Trademark Office ("USPTO"), and published as International Publication No. WO 2015/130308 A1 on Sep. 3, 2015, the entire contents of which are incorporated herein by reference.

TECHNICAL FIELD

The present invention relates to electrical cables with strength elements. More specifically, the present invention relates to electrical cables with strength elements extending along the length of the electrical cables to increase tensile strength of the electrical cables.

BACKGROUND

Tensile strength is an important attribute of electrical cables. Tensile strength may be of particular concern for power cables having long runs in vertical or substantially vertical orientations (hereinafter referred to as "vertical run"), such as in mineshafts and high-rise buildings, especially in case of large cables (having conductor sizes greater than about 53.5 $mm^2$ or 1/0 AWG).

In this disclosure, by "run" it is meant a cable section freely standing between two consecutive bearing points.

In order to provide a sufficient safety factor, it may be necessary that the tensile strength of the electrical cable be several times the force exerted by the weight of the specific run of electrical cable. Industry-standard safety factors of up to 7 (e.g., tensile strength seven times the weight of the run of electrical cable) may be required dependent upon application.

For long vertical runs, the conductors of an electrical cable typically cannot provide sufficient tensile strength. In order to alleviate this problem, offset cable runs and/or tensile strength elements included as part of the structure of the electrical cable may be used.

In an offset cable run, a vertical run of the electrical cable may be interrupted by a bend at an angle as high as 90° or more at, for example, a junction box, and then run horizontally or substantially horizontally for some distance (typically not less than twice the diameter of the electrical cable) before resuming a vertical run. In this way, the long vertical run is split into two or more shorter vertical runs. A long vertical run may often require multiple offsets and this complicates the installation and consumes valuable real estate in a given footprint. As a result, offsets may not be practical for long vertical runs.

Tensile strength elements included as part of the structure of the electrical cable may take a number of forms.

U.S. Pat. No. 4,956,523 relates to an armored electric cable having integral tensile members to provide additional tensile strength. The tensile members are embedded in an inner polyvinyl chloride (PVC) jacket which securely grips the central insulated conductors over which it is extruded. The jacket is, in turn, securely gripped by an armor cover formed of a steel strip. Thus, in the vertical position, much of the weight of the insulated conductors, jackets, and armor coating can be supported by the tensile members without producing dangerous longitudinal slippage or creepage between them. However, with inner PVC jacket and armor cover, this cable design is very heavy.

Also, the Applicant has experienced that tensile elements provided into the interstices between insulated conductors may slip in between the conductors under tensile load at the cable operating temperatures.

U.S. Pat. No. 4,467,138 relates to a communication wire of flat construction. The cable pairs are located on opposite sides of a central reinforcing or support wire which can consist of a copper clad steel wire. Although communication wire may have long vertical runs, the structure and, especially, the weight of a communication wire is significantly different than an electrical cable for power transmission.

U.S. Pat. No. 4,002,820 relates to a power cable having an extensible ground check conductor for use in mining operations. The cable includes a cradle, at the center of which is inserted the ground check conductor. The cradle supports three helically wound power conductors made up of a plurality of strands of metallic wires covered with a layer of elastomeric insulation. The cradle is made of a semi-conducting insulating material consisting of the same elastomeric material as the insulation, but containing a predetermined amount of carbon black. The cradle also supports three grounding conductors inserted one between each power conductor. The grounding conductors are each made up of a plurality of strands of metallic wires and are covered with a semi-conducting elastomeric layer of the same material as the cradle.

German Patent Publication No. DE 32 24 597 A1 relates to a power cable containing, in the core or in the interstices of the stranded electrical conductors symmetrically distributed over the cross-section of the line, one or more optical conductors which are provided with an outer braiding or mesh made of tensile elements and which take over the entire capacity of the line. As tensile elements, steel or plastic strands or steel-copper mixed strands are considered.

"Flexible Electric Cables for Mining Applications", page 39 (Pirelli, 2000), teaches that flexible electric cables for mining applications should not be stressed above the set-out limits for the permissible tensile forces. If higher tensile forces are to be expected, support elements have to be provided as part of the structure of the cable. A support element can be located in the center of the cable.

These problems are not limited to electrical cables with long vertical runs. Other situations may arise in which the tensile strength of electrical cables may be of particular concern.

Related art electrical cables are discussed, for example, in U.S. Patent Publication No. 2012/0082422 A1 to Sarchi et al. and in "Flexible Electric Cables for Mining Applications", discussed above.

SUMMARY

Applicant has faced the technical problem of providing tensile strength for electrical cables for power transmission and distribution that have long vertical runs. Tensile strength elements are typically provided in the structure of electrical cables for this kind of application. Tensile strength elements may be stranded with the core elements of the electrical cable. However, Applicant has noted that when subjected to operating temperatures under tensile load, the tensile strength elements may slip in between the insulated conductors. Under load, the helix formed by the tensile strength members may tighten and cause the tensile strength members to intrude between the core elements, unwinding them and altering the cable geometry, the elongation of the cable, and the transfer of load to the core elements.

In the case of a tensile strength element provided in the axial central position of an electrical cable, Applicant has noted that the center tensile strength element typically is not as flexible as a plurality of tensile strength elements stranded with the cable core, it is not easily accessed for clamping, and the use thereof as the primary support element typically is acceptable only for shorter lengths of vertical runs and/or smaller diameter cable sizes.

Applicant has found that the problems above can be solved by stranding insulated conductors and tensile strength members of the electrical cable around a cradle having a predetermined mechanical resistance and capable of retaining its shape and features at the cable operating temperature.

In particular, the cradle is configured to bear the compression forces exerted by the core elements and tensile strength members, particularly when the tensile strength members are under tension at the cable operating temperature.

In a first aspect, the present invention relates to an electrical cable comprising:

at least two first members extending along a length of the electrical cable, each of the first members comprising a conducting element and an insulating layer radially external to the conducting element;

at least two second members extending along the length of the electrical cable, each of the second members comprising a strength element and a conductive layer radially external to the strength element;

the first and second members being stranded around and in contact with a cradle extending along the length of the electrical cable;

wherein the cradle is made of polymeric material having a tensile modulus greater than or equal to 1 GPa and a Vicat softening temperature greater than or equal to 125° C.

The strength elements of the second members act as tensile strength members in the cable of the invention. Preferably, the strength elements are made of polymeric material, thus resulting in strength elements lighter than elements made of metallic material. Preferably, the conductive layer of a second member is made of a metal (e.g., copper, aluminum, or alloys or composites thereof) having a thickness suitable to perform as a ground conductor. Said thickness is sized in view of national or international standards, as reported, for example, by Practical Guide To Electrical Grounding, W. Keith Switzer, 1999, page IV (Library Of Congress Catalog Card Number: 99-72910).

For the purpose of the present description and of the appended claims, except where otherwise indicated, all numbers expressing amounts, quantities, percentages, and so forth are to be understood as being modified in all instances by the term "about". Also, all ranges include any combination of the maximum and minimum points disclosed and include any intermediate ranges therein, which may or may not be specifically enumerated herein.

The electrical cables of the invention may be low voltage cables, medium voltage cables, or high voltage cables. In this disclosure, by "low voltage", it is meant a voltage less than 1 kilovolt (kV); by "medium voltage", it is meant a voltage greater than or equal to 1 kV and less than or equal to 35 kV; and by "high voltage", it is meant a voltage greater than 35 kV.

The electrical cables of the example embodiments are preferably used for alternating current (AC) power transmission.

In this disclosure, by "electrically insulating layer", it is meant a covering layer made of material having insulating properties, namely having a dielectric rigidity (dielectric breakdown strength) suitable for the cable's intended voltage operation according to the local or international standards.

In this disclosure, by "expanded polymer", it is meant a polymer that has a percentage of its volume not occupied by the polymer, but by air or gas, or by expandable microspheres or a similar technology. In this disclosure, by "unexpanded polymer", it is meant a polymer that does not have a percentage of its volume occupied by air or gas, or by expandable microspheres or a similar technology.

In this disclosure, by "semiconductive layer", it is meant a covering layer made of material having semiconductive properties, such as a polymeric matrix with carbon black, for example, so as to obtain a volumetric resistivity value, at room temperature, of less than 500 ohm-meters (Ω-m), and preferably less than 20 Ω-m. The amount of carbon black may vary, for example, between 1% and 50% by weight relative to the weight of the polymer, and preferably between 3% and 30% by weight relative to the weight of the polymer.

In this disclosure, by "reinforcing filler", it is meant a filler—typically a particulate or filamentary material—capable of improving the mechanical characteristics of the material in which it is dispersed.

The first members of the cable of the invention can comprise, further to a conducting element and an insulating layer radially external to the conducting element, an inner and, optionally, an outer semiconductive layer. The inner semiconductive layer is positioned between and in contact with the conducting element and the insulating layer. The outer semiconductive layer is provided in radially external position and in contact with the insulating layer.

Advantageously, the first members can comprise a metallic screen provided in radially external position with respect to the insulating layer and, in some cases, to the outer semiconductive layer.

In some example embodiments, the strength element of a second member is made of a material—advantageously, a polymeric material—having a breaking strength such as to provide at least a minimum safety factor (SF), as defined by the applicable standard or design rule. Advantageously, the breaking strength value for the strength elements in the cable of the invention is such as to exceed the minimum SF by 10-20% at most.

In this disclosure, by "safety factor", it is meant a term describing the structural capacity of an element or system beyond the expected loads or actual loads. It is calculated as follows:

$$SF=(N\times B)/(CW\times L)$$

wherein N is the number of strength members;

wherein B is the breaking strength of the strength members;

wherein CW is the cable weight per unit length; and wherein L is the length of vertical run of the cable.

Further parameters can be considered while calculating SF, according to a specific cable layout. For example, the skilled person could include a parameter related to the method of termination of the cable ends.

The minimum SF is set by national or international standards, for example, by ICEA S-93-639-2012 which, in the case of vertical cables, prescribes an SF not less than 5 for borehole applications and not less than 7 for shaft applications.

The tensile modulus of the cradle material of the invention is according to ASTM D638-10. In some example embodiments, the material of the cradle has a tensile modulus less than or equal to 1.7 GPa. Preferably, a cradle material has a tensile modulus greater than or equal to 1.0 GPa.

The Vicat softening temperature of the cradle material of the invention is according to ASTM D1525-09. The Vicat softening temperature of the cradle can be as high as 160° C. or more. The highest suitable Vicat value can be selected in view of the maximum emergency operating temperatures called for by a specific national or international standard for the cable.

Preferably, the cradle comprises a deformation-resistant engineering polymeric material. In particular, the cradle comprises a deformation-resistant engineering plastic rated for at least 90° C. In this disclosure, by "deformation-resistant engineering plastic", it is meant a material with Shore D hardness of from 45 to 75 (measured according to ASTM D2240-05 at room temperature).

In some example embodiments, a material of the cradle can be selected from glass fiber or thermoplastic material such as a polyethylene terephthalate, polyamide, a polyester, polypropylene, polyethylene—for example, high density polyethylene—the thermoplastic material being optionally added with an inorganic reinforcing filler such as nanoclay, aramid fiber, or glass fiber.

In some example embodiments, each second member is stranded between two first members.

In some example embodiments, the cradle comprises a longitudinally extending, axially centered channel configured to house at least one optical-fiber element.

Preferably, the first members are stranded with the maximum lay length allowed by the selected national or international standard. This allows limiting the rotational forces arising in the cable, while not adversely affecting the flexibility of the cable. The second members advantageously have the same helical lay as the first members.

The electrical cable according to the invention may include 2, 3, 4, or more first members. The first members may be arranged in a symmetric manner, such as having an axis or axes of symmetry and/or rotational symmetry.

The electrical cable according to the invention may include 2, 3, 4, or more second members. The second members may be arranged in a symmetric manner, such as having an axis or axes of symmetry and/or rotational symmetry.

The number of first members to the number of second members may be multiples of each other. There may be, for example, two first members and two or four or six second members, or three first members and three or six or nine second members. Conversely, there may be, for example, two second members and two or four or six first members, and so on. This construction relationship is suitable for preserving the cable symmetry.

The cable of the invention may further comprises a sheath radially external the first and second members and, advantageously, a filler between the sheath and the first and second members. In radially external position with respect to the filler and in radially internal position with respect to the sheath, further layers can be present such as an expanded polymer layer, a continuous coating layer acting as a chemical barrier, and a sealing layer. Preferably, at least the expanded polymer layer and the sealing layer are present, the second external to the first. More preferably the continuous coating layer acting as a chemical barrier is present, interposed between the expanded polymer layer and the sealing layer.

It is to be understood that both the foregoing general description and the following detailed description are exemplary and explanatory only, and are not restrictive of the invention as claimed.

BRIEF DESCRIPTION OF THE DRAWINGS

The above and/or other aspects and advantages will become more apparent and more readily appreciated from the following detailed description of example embodiments, taken in conjunction with the accompanying drawings, in which.

DETAILED DESCRIPTION OF EXAMPLE EMBODIMENTS

Figure 1:
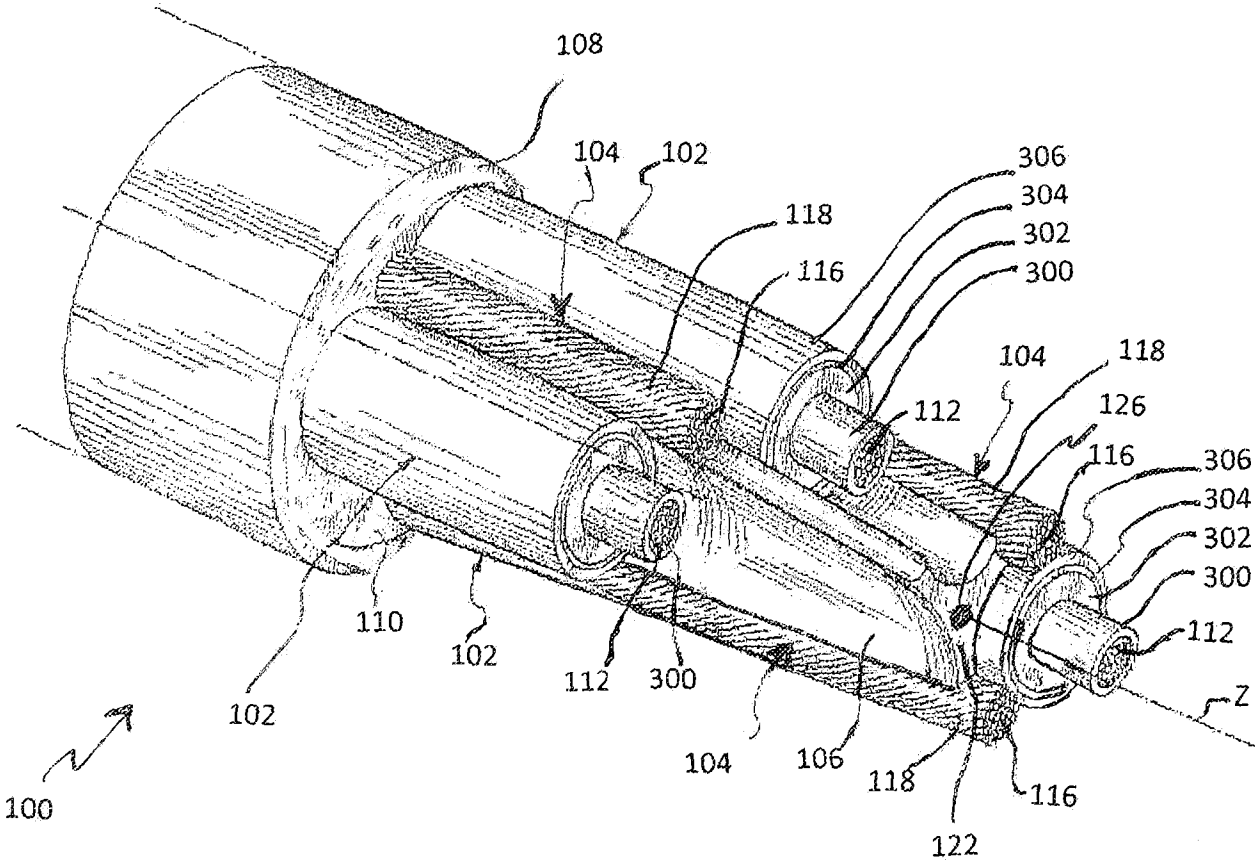
FIG. 1 is a perspective view of an electrical cable according to some example embodiments.

Example embodiments will now be described more fully with reference to the accompanying drawings. Example embodiments, however, may be embodied in many different forms and should not be construed as being limited to the example embodiments set forth herein. Rather, these example embodiments are provided so that this disclosure will be thorough and complete, and will fully convey the scope to those skilled in the art. In the drawings, whenever possible, like numbers refer to like elements.

Figure 2:
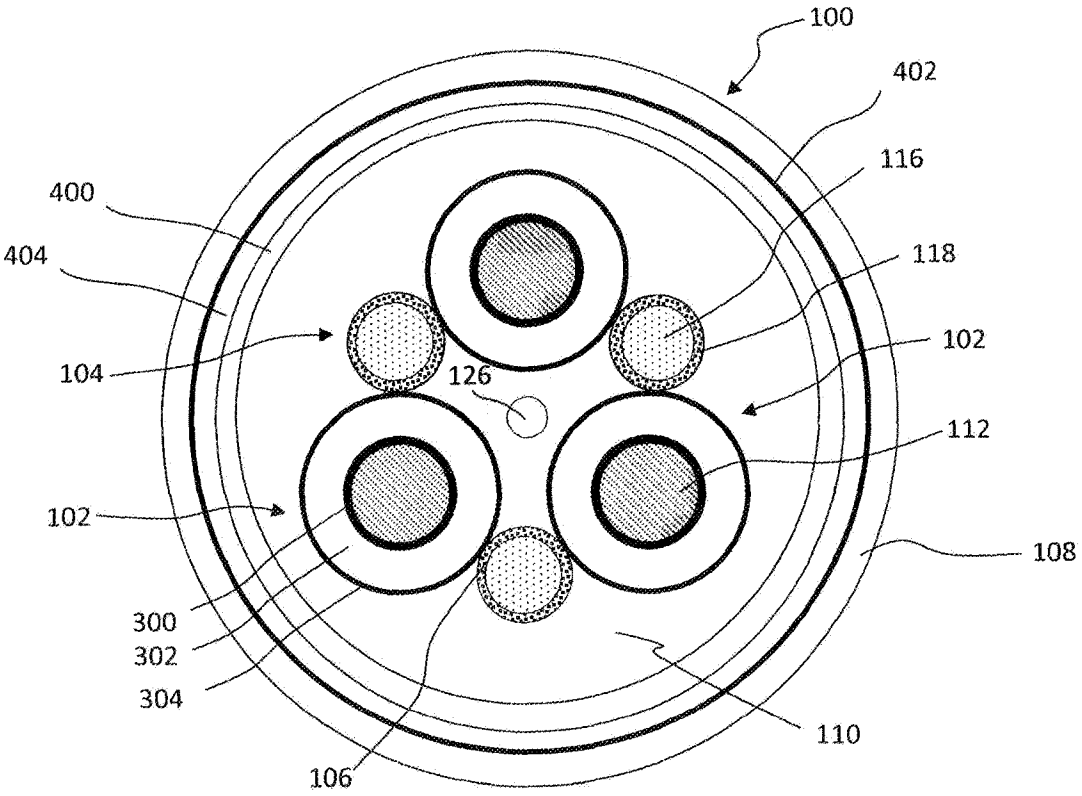
FIG. 2 is a cross-sectional sketched view of the electrical cable of FIG. 1 according to some example embodiments.

In FIGS. 1 and 2, the same reference numbers are used to identify like components having the same or similar functions.

In FIGS. 1 and 2, electrical cable 100 comprises three first members 102 stranded along the length of electrical cable 100; three second members 104 stranded along the length of electrical cable 100; cradle 106 extending along the length of electrical cable 100; outer jacket 108 radially external to first members 102 and second members 104; and filler 110 between outer jacket 108 and both first members 102 and second members 104.

First members 102 comprise a conducting element 112 and an insulating layer 302 radially external to at least one conducting element 112.

Conducting elements 112 generally comprises electrically conducting components usually made from metallic material, preferably copper, aluminum, or alloys thereof, either as solid rods or metal wires twisted together by conventional methods.

For example, a conducting element 112 can comprise three 2/0 solid copper conductors, each rated for 15 kV, In FIGS. 1 and 2 each conducting element 112 is further surrounded by two semiconducting layers, in particular an inner semiconducting layer 300, provided between the conducting element 112 and the insulating layer 302, and an outer semiconducting layer 304 provided in radially external position with respect to the insulating layer 302. A metallic screen 306 (not illustrated in FIG. 2, but having position and feature as in FIG. 1 provided in radially external position with respect to the outer semiconducting layer 304.

The insulating layer 302 may be made of polymeric material, for example polyethylene (typically cross-linked), poly-propylene, copolymers (e.g., ethylene-propylene rubber), or mixtures thereof. The semiconducting layers 300, 304 are typically made of material charged with conductive filler such as carbon black and based on a polar polymer (for example, ethylene-vinyl acetate or ethylene ethyl acrylate optionally in admixture with polymer material analogous to that employed for the insulating layer 302.

Preferably, metallic screen 306 comprises a copper tape shield.

Second members 104 comprise a strength element 116 and a conductive layer 118 radially external to the strength element 116.

Strength elements 116 can comprise aramid or para-aramid synthetic fibers, either as solid rods or as rope strands twisted together by conventional methods. For example, strength elements 116 can be stranded ropes made of Technora® or Kevlar® aramid and marketed by Phillystran.

Conductive layers 118 generally comprise electrically conducting components applied to external surfaces of strength elements 116, usually made from metallic material, preferably copper, aluminum, composites or alloys thereof, either as a braid, helical coiled tape or wire, sheet, or equivalent.

Conductive layers 118 can comprise metallic braids or, preferably, helically coiled metallic wires applied around the rope cores. For example, concentric neutral wire with diameter of from 8.36 $mm^2$ to 2.08 $mm^2$ may be used for grounds having a diameter of about 35 $mm^2$ (2 AWG), while wires with diameter of from 0.82 $mm^2$ to 0.20 $mm^2$ may be used for smaller grounds.

For example, conductive layers 118 comprise copper braids or helical coils of copper wire with an equivalent ground section of 21.14 $mm^2$ by applying 22 wires of 0.33 $mm^2$ copper to strength elements 116. Depending on the radius of strength elements 116, the coverage (i.e., surface amount covered by wire) of such conductive layers 118 over strength elements 116 may be only 36% or lower, may be 64% or higher, or may be some value between 36% and 64%.

For example, in the second members 104, conductive layers 118 comprise helical coils of copper wire less than or equal to 8.36 $mm^2$ and greater than or equal to 0.0127 $mm^2$.

Conductive layers 118 comprising the electrically conducting components ease the second members 104 to act as electrical grounding members when in contact with metallic screen 306 (e.g., copper tape shield) of the first members 102.

Cradle 106 is suitably centered within the cross-section of electrical cable 100. Preferably, cradle 106 exhibits symmetry with respect to the cross-section of electrical cable 100. More preferably, the symmetry may be axial symmetry (e.g., 2 or 4 axes of symmetry) and/or rotational symmetry (e.g., 90°, 120°, or 180°).

Preferably, a material of cradle 106 has a tensile modulus greater than or equal to 1.0 GPa and less than or equal to 1.7 GPa.

In the cable according to FIG. 1, cradle 106 comprises a longitudinally extending channel 126. Preferably, longitudinally extending channel 126 is axially centered in cradle 106 along central axis Z. Longitudinally extending channel 126 can be configured to house at least one optical-fiber element. Preferably, electrical cable 100 further comprises at least one optical-fiber element housed in longitudinally extending channel 126.

First members 102 and second members 104 are stranded around cradle 106 to define an assembly that comprises first members 102 and second members 104. Outer jacket 108 is radially external to the assembly. Preferably, outer jacket 108 is made of polymeric material, for example high density polyethylene. Filler 110 is between assembly and outer jacket 108. Preferably, filler 110 is provided on the assembly by extrusion and is based on polymeric material, for example ethylene propylene diene monomer (EPDM) rubber, PVC, thermoplastic vulcanizate (TPV), or polyvinylidene fluoride (PVDF).

The polymeric material of filler 110 can be either unexpanded or expanded. Filler 110 comprising an expanded polymer should result in electrical cable 100 being lighter per unit length than a similar cable comprising an unexpanded polymer, potentially allowing longer vertical runs while maintaining the required industry-standard safety factor. In addition or in the alternative, electrical cable 100 being lighter per unit length should allow the use of smaller strength elements 116 and/or second members 104, allowing for further savings in weight per unit length. Expandable fillers suitable for the present invention are described, for example, in U.S. Pat. No. 6,501,027 B1, U.S. Pat. No. 7,465,880 B2, and PCT/IB2013/002426.

Further protective layers can be provided between the filler 110 and the outer jacket 108, such as an expanded or unexpanded polymer layer 400, for example as described in PCT/IB2013/002426 or in U.S. Pat. No 7,465,880 B2.

As from FIG. 2, the cable of the invention preferably comprises a sealing layer 402 made, for example, of polymer-coated metallic tape with overlap sealed with an adhesive layer over the expanded polymer layer 400, and surrounded by a continuous coating layer acting as a chemical barrier 404 made, for example, of a polyimide.

Advantageously, first members 102 contact second members 104. Preferably, each first member 102 contacts at least one second member 104. More preferably, each first member 102 contacts two second members 104.

The assembly of first and second members 102, 104 defines first zone 122 radially internal to the assembly. Advantageously, cradle 106 substantially occupies an entirety of first zone 122.

The assembly defines a second zone radially external to the assembly, but radially internal to sheath 108. Filler 110 can substantially occupy an entirety of the second zone by filling almost any otherwise empty space in the second zone under sheath 108 and in the interstices of first members 102 and second members 104.

Preferably, the polymer material of the filler 110 extends beyond and overlays the assembly and the second zone, such that an annular ring surrounds the assembly and the second zone. This extension of the filler 110 over the assembly and the second zone (also referred to as an annular layer) can have a thickness greater than or equal to about 0.1 mm and less than or equal to about 6.0 mm, but greater radial thicknesses may be used, depending on a diameter of electrical cable 100 and/or the intended application of electrical cable 100.

Preferably, each of second members 104 is stranded between two of first members 102.

Advantageously, first members 102 are stranded with the maximum lay length allowed by the selected national or international standard. For example, according to ICEA 639, for a two-core cable, the lay-length is thirty (30) times the diameter of the conductor 112; for a three-core cable, the lay-length is thirty-five (35) times the diameter of the conductor; for a four-core cable, the lay-length is forty (40) times the diameter of the conductor; for a cable having more than four cores, the lay-length is fifteen (15) times the diameter of the cable assembly.

When second members 104 are under tension, particularly when electrical cable 100 is at elevated temperature, second members 104 tend to pull toward the center of electrical cable 100. In the absence of cradle 106, this tendency of second members 104 to pull toward the center of electrical cable 100 could displace first members 102 away from the center of electrical cable 100, spreading first members 102. However, as discussed above, because the first members 102 and the second members 104 are configured to be in contact with cradle 106, cradle 106 acts to prevent such spreading of first members 102. Thus, cradle 106 functions to support and maintain the positions of first members 102 and second members 104, ensuring the structural stability of electrical cable 100. Cradle 106 functions as a mechanical spreader for second members 104 too, particularly when second members 104 are under tension.

The overall torsional rigidity of an electrical cable according to the invention can be significant, especially when the conducting elements comprise an electrically conducting component made from metal wires twisted together. In this case, the conducting elements may start to unwind, changing the lay length of conducting elements and subjecting strength elements to additional tension, a potentially significant problem in vertical or substantially vertical orientations.

The torsional rigidity of a number of constituents of an electrical cable contributes to the overall torsional rigidity of cable itself. In particular, an expanded polymer layer 400 and sealing layer 402 tend to be torsionally rigid. Especially, a sealing layer 402 made of polymer-coated metallic tape, with overlaps in the polymer-coated metallic tape sealed by an adhesive layer, tends to retain its torsionally rigidity both at operating temperatures (e.g., 90° C.) and at emergency temperatures (e.g., 140° C.) of the electrical cable. High torsional rigidity of electrical cable 100 endowed with an expanded polymer layer 400 and, preferably, a sealing layer 402 across the range of normal operating temperatures tends to combat these unwinding and additional tension effects.

Further approaches were envisaged to reduce torsional stress in an electrical cable according to the invention.

In the case of electrical cable 100 according to FIG. 1, when conducting elements 112 comprise an electrically conducting component made from metal wires twisted together, the lay of the first members 102 is made advantageously opposite to that of the metal wires twisted together. In addition or in the alternative, when strength elements 116 are rope strands twisted together, the lay of the second members 104 is opposite to that of the rope strands twisted together.

As discussed above, the lay length of first members 102 and, accordingly, of second members 104 is advantageously controlled relative to the diameter of the conducting element 112. The lay length is the maximum set forth by the selected national or international standard—for example, ICEA 639.

For purposes of manufacturing an electrical cable according to the invention, the cradle may be extruded. First members 102 and second members 104 may be stranded around the extruded cradle 106.

For purposes of manufacturing electrical cable 100, a planetary-style cabler that provides seven positions is capable of cabling cradle 106, first members 102, and second members 104. However, if second members 104 did not comprise both a strength element 116 and a conductive layer 118, a cabling on a planetary-style cabler with more than seven positions should be used for including at least a separate ground conductor. The use of a planetary-style cabler with more than seven positions is complicated from an industrial point of view because of the limited availability of this machinery and the scarce practicality thereof, especially in the manufacturing of large cable (having conductor sizes greater than about 53.5 $mm^2$ or 1/0 AWG).

Figure 3:
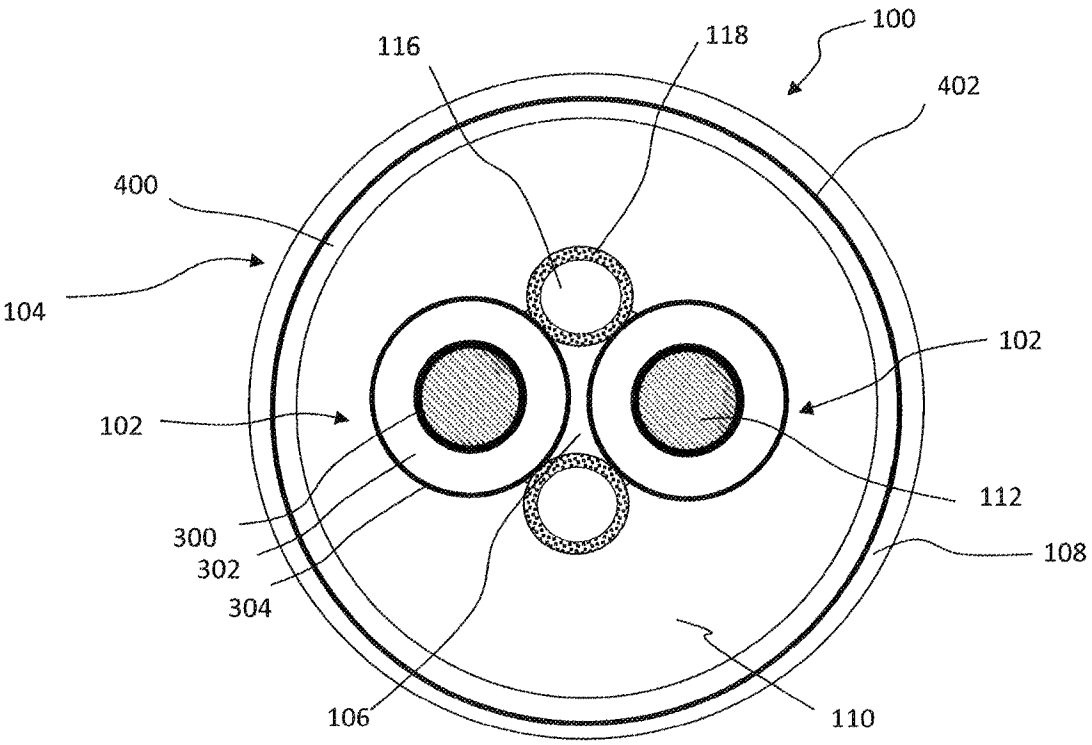
FIG. 3 is a cross-sectional view of an electrical cable according to some example embodiments.

FIG. 3 is a sketched cross-sectional view of an electrical cable 100 with second members 104 extending along the length of electrical cable 100, with first members 102 and with an outer jacket 108, according to some example embodiments. In FIG. 3, the same reference numbers are used to identify like components having the same or similar functions in FIGS. 1 and 2.

In the present case, as in the case of the cable of FIGS. 1 and 2, the number of first members 102 is equal to the number of second members 104.

The cable 100 of FIG. 3 differs from those of FIGS. 1 and 2 in that it comprises two first members 102 and two second members 104. Also, a chemical barrier as 404 in FIG. 2 is not depicted, but can be advantageously provided in this kind of cable.

In FIG. 3, cradle 106 is centered within the cross-section of electrical cable 100. In particular, cradle 106 exhibits symmetry with respect to the cross-section of electrical cable 100. Cradle 106 exhibits two axes of symmetry with respect to the cross-section of electrical cable 100, as well as 180° rotational symmetry.

Figure 4:
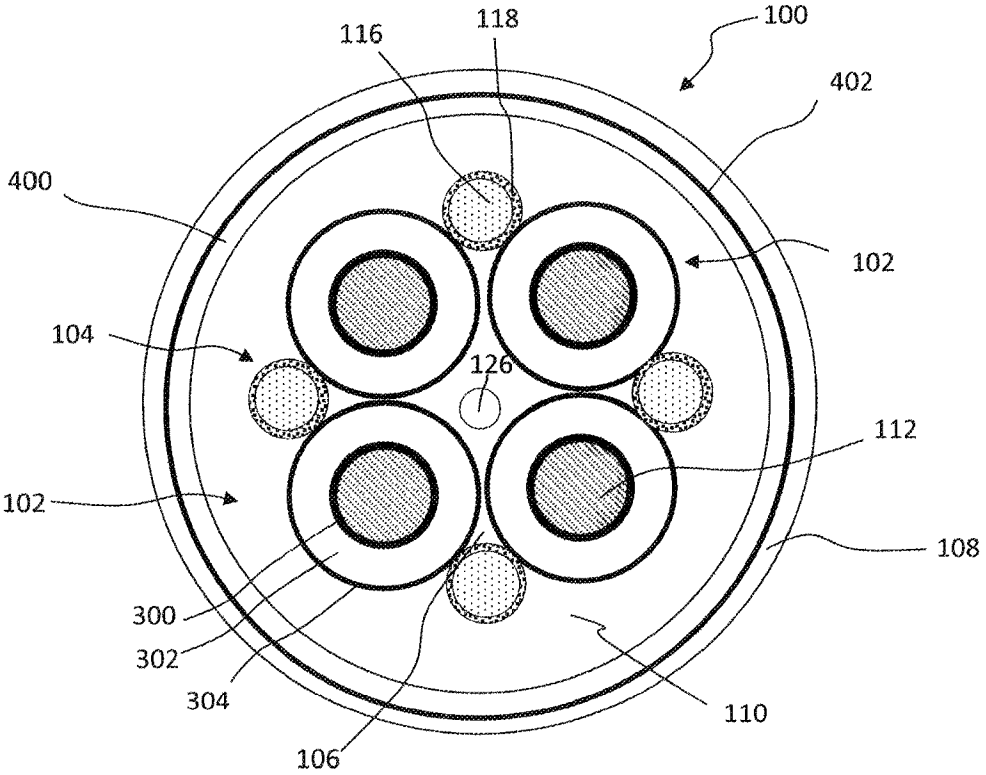
FIG. 4 is a cross-sectional view of an electrical cable according to some example embodiments.

FIG. 4 is a sketched cross-sectional view of an electrical cable 100 with second members 104 extending along the length of electrical cable 100, with first members 102 and with an outer jacket 108, according to some example embodiments. In FIG. 4, the same reference numbers are used to identify like components having the same or similar functions in FIGS. 1 and 2. Also, a chemical barrier as 404 in FIG. 2 is not depicted, but can be advantageously provided in this kind of cable.

In the present case, as in the case of the cable of FIGS. 1 and 2, the number of first members 102 is equal to the number of second members 104. There may be, for example, four first members and four second members.

The cable of FIG. 4 differs from those of FIGS. 1 and 2 in that it comprises four first members 102 extending along the length of electrical cable 100 and four second members 104.

In FIG. 4, cradle 106 is centered within the cross-section of electrical cable 100. In particular, cradle 106 exhibits symmetry with respect to the cross-section of electrical cable 100. Cradle 106 exhibits two axes of symmetry with respect to the cross-section of electrical cable 100, as well as 180° rotational symmetry.

Figure 5:
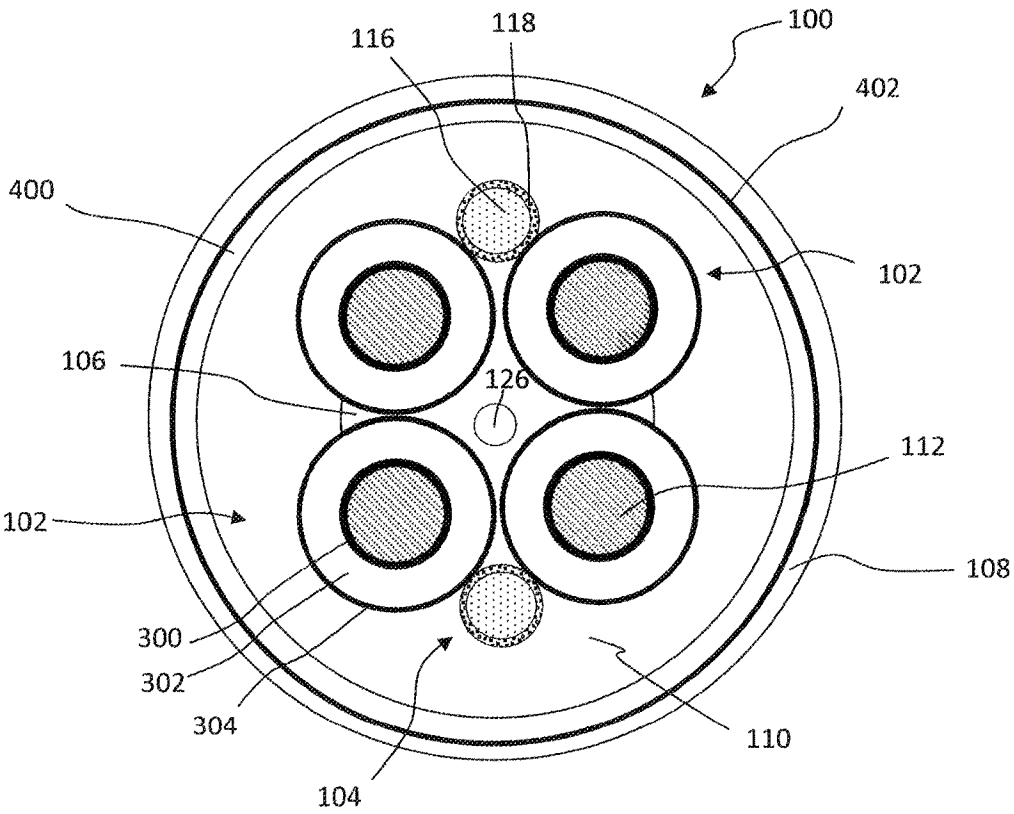
FIG. 5 is a cross-sectional view of an electrical cable with strength elements extending along the length of the electrical cable, with the at least one insulating layer of the first members depicted as a single layer and the sheath of the electrical cable depicted as a single layer, according to some example embodiments.

FIG. 5 is a sketched cross-sectional view of an electrical cable 100 with second members 104 extending along the length of the electrical cable 100, with first members 102 and with an outer jacket 108, according to some example embodiments. In FIG. 5, the same reference numbers are used to identify like components having the same or similar functions in FIGS. 1 and 2. Also, a chemical barrier as 404 in FIG. 2 is not depicted, but can be advantageously provided in this kind of cable.

In the present case, the number of first members 102 is greater than the number of second members 104. In particular, the cable 100 of FIG. 5 comprises four first members 102 and two second members 104.

FIG. 5 differs from FIGS. 1 and 2 in that electrical cable 100 in FIG. 5 comprises four first members 102 extending along the length of electrical cable 100 and two second members 104 extending along the length of electrical cable 100.

In FIG. 5, cradle 106 is centered within the cross-section of electrical cable 100. In particular, cradle 106 exhibits symmetry with respect to the cross-section of electrical cable 100. Cradle 106 exhibits two axes of symmetry with respect to the cross-section of electrical cable 100, as well as 180° rotational symmetry.

Figure 6:
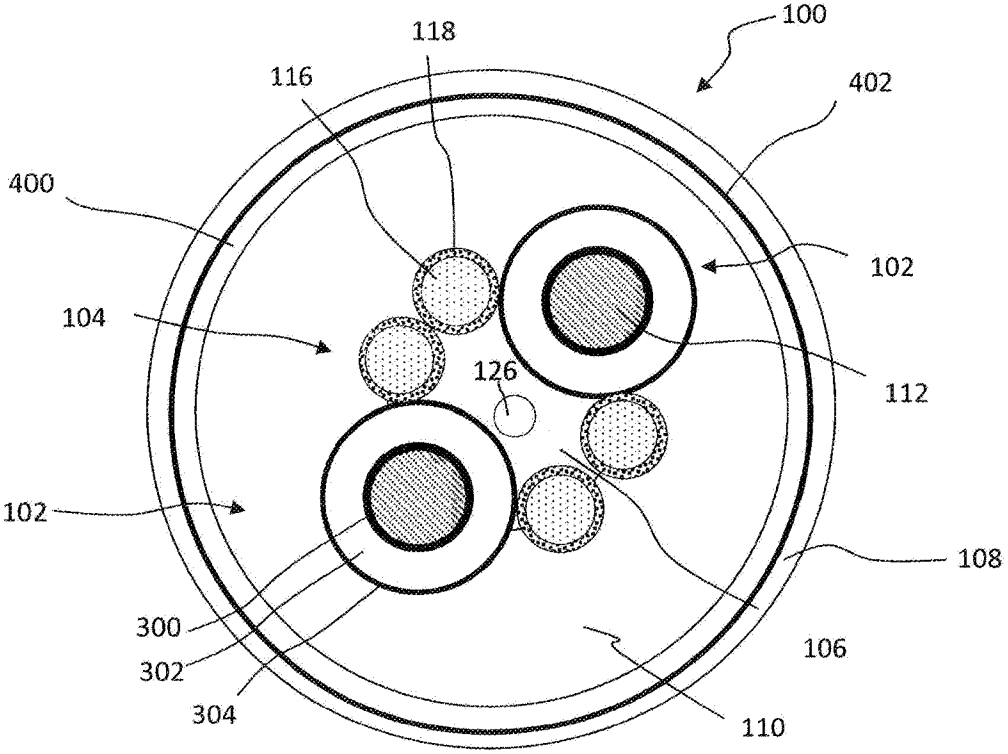
FIG. 6 is a cross-sectional view of an electrical cable with strength elements extending along the length of the electrical cable, with the at least one insulating layer of the first members depicted as a single layer and the sheath of the electrical cable depicted as a single layer, according to some example embodiments.

FIG. 6 is a sketched cross-sectional view of an electrical cable 100 with second members 104 extending along the length of electrical cable 100, with first members 102 and with an outer jacket 108, according to some example embodiments. In FIG. 6, the same reference numbers are used to identify like components having the same or similar functions in FIGS. 1 and 2. Also, a chemical barrier as 404 in FIG. 2 is not depicted, but can be advantageously provided in this kind of cable.

In the present case, the number of first members 102 is less than the number of second members 104. In particular, cable 100 of FIG. 6 comprises two first members 102 and four second members 104.

In FIG. 6, cradle 106 is centered within the cross-section of electrical cable 100. In particular, cradle 106 exhibits symmetry with respect to the cross-section of electrical cable 100. Preferably cradle 106 exhibits two axes of symmetry with respect to the cross-section of electrical cable 100, as well as 180° rotational symmetry.

While example embodiments have been particularly shown and described, it will be understood by those of ordinary skill in the art that various changes in form and details may be made therein without departing from the spirit and scope of the present invention as defined by the following claims.

EXAMPLES

Two variations of the cable of the invention are described. Cables A and B both comprised three 70 $mm^2$ (2/0) copper conductors, rated for 15 kV, insulated with ethylene-propylene rubber (EPR), assembled around a center cradle. Also assembled around the center cradle were three strength elements of aramid ropes covered by a copper layer acting as conductive (ground) wires. Surrounding an enclosing the assembled core was a filler of EPDM rubber, which overlaid the core elements. Surrounding the filler there was a sheath system of multiple layers. The layers comprised a continuous coating layer of polyimide acting as a chemical barrier and an outer plastic jacket. Two layers intermediated the EPDM rubber and the polyimide layer comprising an expanded polypropylene-based layer and a polymer-coated metallic tape with overlap sealed with an adhesive layer.

In particular, Cable A comprised aramid ropes (commercially available from Phillystran) having a breaking strength of 102 kN (23,000 pounds), while Cable B comprised aramid ropes (commercially available from Phillystran) having a breaking strength of 34 kN (7,700 pounds). Cable A, having higher rated strength members might be designed, for example, for a longer vertical drop.

Both Cable A and B were provided with the equivalent of 25 $mm^2$ (4 AWG) ground section by applying 22 wires of 0.34 $mm^2$ (22 AWG) copper over the strength elements. In the case of the Cable A, this translated into 36% coverage of copper over the strength element. In the case of the Cable B, this translated into 64% coverage of copper over the strength element.

Cable A has a weight of 65.6 N/meter (4.5 $lbs_f$/foot) and was intended for a vertical drop of 667.5 meters (2,190 feet) in a rnineshaft (weight force of the run=43,837 N or 9,855 $lbs_f$). Then, for a safety factor of at least 7 according to ICEA S-93-639-2012, the cable strength elements shall have a combined breaking strength of 306.8 kN (68,985 $lbs_f$)—in the present case, three aramid ropes as strength members, each having a breaking strength of at least 102.28 kN (22,995 $lbs_f$). In Cable A, each rope selected exceeded this amount by 20%, as it had a breaking strength of 122.7 kN (27,594 $lbs_f$) each.

Cable B has a weight of 65.6 N/meter (4.5 $lbs_f$/foot) and was designed for a vertical drop of 304.8 meters (1000 feet) in a borehole (weight force of the run=20,017 N or 4,500 $lbs_f$). Then, for a safety factor of at least 5 according to ICEA S-93-639-2012, its strength elements shall have a combined breaking strength of 100.1 kN (22,000 $lbs_f$)—in the present case, three aramid ropes as strength members, each having a breaking strength of at least 33 kN (7,400 $lbs_f$). In Cable B, each aramid rope selected exceeded this amount by 20%, as it had a breaking strength of 39.6 kN (8,902 $lbs_f$).

It should be understood that one skilled in the art would be able select the proper strength elements with the appropriate breaking strength based on the number of strength elements, overall cable weight/unit length, safety factor required, and vertical drop using the examples above.

What is claimed is:

1. An electrical cable, comprising:

at least two first members extending along a length of the electrical cable, each of the first members comprising a conducting element and an insulating layer radially external to the conducting element;

at least two second members extending along the length of the electrical cable, each of the second members comprising a strength element and a conductive layer radially external to the strength element; and the first and second members being stranded around and in contact with a cradle extending along the length of the electrical cable;

wherein the cradle is made of polymeric material having a tensile modulus greater than or equal to 1 GPa and less than or equal to 1.7 GPa, and a Vicat softening temperature greater than or equal to 125° C, wherein the conducting element of each of the first members comprises metal wires twisted together according to a first lay, wherein the first members are stranded according to a second lay, and wherein the first lay is in a first direction opposite to that of the second lay.

2. The cable of claim 1, wherein the conductive layer is made of metal having a thickness suitable to perform as a ground conductor.

3. The cable of claim 1, wherein the first members further comprise a metallic screen provided in radially external position with respect to the insulating layer.

4. The cable of claim 3, wherein the conductive layer is in contact with the metallic screen.

5. The cable of claim 1, wherein the strength element is made of polymeric material.

6. The cable of claim 1, wherein the strength element is made of material having a breaking strength such as to provide at least a minimum safety factor.

7. The cable of claim 1, wherein the cradle is made of material selected from glass fiber or thermoplastic material.

8. The cable of claim 7, wherein the thermoplastic material is added with inorganic reinforcing filler.

9. The cable of claim 1, wherein the cradle is made of material having a Shore D hardness of from 45 to 75.

10. The cable of claim 1, wherein each of the second members is stranded between two of the first members.

11. The cable of claim 1, wherein a number of the first members is equal to a number of the second members, wherein the number of the first members is a multiple of the number of the second members, or wherein the number of the second members is a multiple of the number of the first members.

12. The cable of claim 1, further comprising, sequentially in radially external position with respect to the first and second members, at least an expanded polymer layer, a continuous coating layer acting as a chemical barrier, or a sealing layer.

13. The cable of claim 1, wherein the first members contact the second members.

14. The cable of claim 1, further comprising:

an outer jacket radially external to the first and second members; and filler between the outer jacket and the first members, and between the outer jacket and the second members.

15. The cable of claim 1, wherein the strength element of each of the second members comprises rope strands twisted together according to a third lay, wherein the second members are stranded according to a fourth lay, and wherein the third lay is in a second direction opposite to that of the fourth lay.

16. The cable of claim 1, wherein the cradle exhibits 90° rotational symmetry.

17. The cable of claim 1, wherein the cradle exhibits 120° rotational symmetry.

18. The cable of claim 1, wherein the cradle exhibits 180° rotational symmetry.

19. An electrical cable, comprising:

at least two first members extending along a length of the electrical cable, each of the first members comprising a conducting element and an insulating layer radially external to the conducting element;

at least two second members extending along the length of the electrical cable, each of the second members comprising a strength element of aramid or para-aramid synthetic fibers, and a conductive layer radially external to the strength element; and the first and second members being stranded around and in contact with a cradle extending along the length of the electrical cable;

wherein the cradle is made of polymeric material having a tensile modulus greater than or equal to 1 GPa and a Vicat softening temperature greater than or equal to 125° C.

20. An electrical cable, comprising:

at least two first members extending along a length of the electrical cable, each of the first members comprising a conducting element and an insulating layer radially external to the conducting element;

at least two second members extending along the length of the electrical cable, each of the second members comprising a strength element and a conductive layer radially external to the strength element; and the first and second members being stranded around and in contact with a cradle extending along the length of the electrical cable;

wherein the cradle is made of polymeric material having a tensile modulus greater than or equal to 1 GPa and less than or equal to 1.7 GPa, and a Vicat softening temperature greater than or equal to 125° C., wherein the strength element of each of the second members comprises rope strands twisted together according to a first lay, wherein the second members are stranded according to a second lay, and wherein the first lay is in a direction opposite to that of the second lay.

* * * * *